US007028666B2

(12) United States Patent
Kamimura et al.

(10) Patent No.: US 7,028,666 B2
(45) **Date of Patent: *Apr. 18, 2006**

(54) THROTTLE APPARATUS FOR AN ENGINE

(75) Inventors: Yasuhiro Kamimura, Ibaraki (JP); Norio Tomita, Ibaraki (JP); Kazuo Nagayama, Ibaraki (JP); Yasushi Sasaki, Ibaraki (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 227 days.

This patent is subject to a terminal disclaimer.

(21) Appl. No.: 10/452,141

(22) Filed: Jun. 3, 2003

(65) Prior Publication Data

US 2003/0209229 A1 Nov. 13, 2003

Related U.S. Application Data

(60) Continuation of application No. 10/012,567, filed on Dec. 12, 2001, now Pat. No. 6,598,587, which is a division of application No. 09/526,479, filed on Mar. 15, 2000, now Pat. No. 6,341,593, which is a division of application No. 09/073,917, filed on May 7, 1998, now Pat. No. 6,067,958.

(30) Foreign Application Priority Data

May 7, 1997 (JP) ..... 9-116906

(51) Int. Cl.
*F02D 9/08* (2006.01)

(52) U.S. Cl. ..... 123/399; 123/337; 123/361

(58) Field of Classification Search ..... 123/399, 123/337, 396, 361; 251/129.11
See application file for complete search history.

(56) References Cited

U.S. PATENT DOCUMENTS

| | | | | |
|---|---|---|---|---|
| 4,860,706 | A * | 8/1989 | Suzuki et al. | 123/337 |
| 4,926,821 | A * | 5/1990 | Porth et al. | 123/399 |
| 5,220,224 | A * | 6/1993 | Bosman et al. | 310/49 R |
| 5,490,487 | A * | 2/1996 | Kato et al. | 123/399 |
| 5,718,202 | A * | 2/1998 | Bentz et al. | 123/399 |
| 5,738,072 | A * | 4/1998 | Bolte et al. | 123/399 |
| 6,067,958 | A * | 5/2000 | Kamimura et al. | 123/337 |
| 6,098,594 | A * | 8/2000 | Kowatari et al. | 123/399 |
| 6,109,240 | A * | 8/2000 | Sato et al. | 123/399 |
| 6,341,593 | B1 * | 1/2002 | Kamimura et al. | 123/337 |
| 6,347,613 | B1 * | 2/2002 | Rauch | 123/337 |
| 6,371,080 | B1 * | 4/2002 | Saito et al. | 123/337 |
| 6,598,587 | B1 * | 7/2003 | Kamimura et al. | 123/399 |

FOREIGN PATENT DOCUMENTS

| | | |
|---|---|---|
| JP | 3-271528 | 12/1991 |
| JP | 4-203219 | 7/1992 |

(Continued)

*Primary Examiner*—Hieu T. Vo
(74) *Attorney, Agent, or Firm*—Crowell & Moring LLP

(57) ABSTRACT

An electronic throttle apparatus permits aggregating of various parts and rationalization of installation, and can simplify assembling operation and wiring operation to an engine room for rationalization of an installation space. The throttle apparatus for an engine includes a throttle body housing therein a throttle valve and disposed in an air intake of the engine, a throttle actuating motor, a throttle position sensor detecting a throttle valve angle and an air flow sensor located on upstream of the throttle valve and measuring an intake air flow rate. The throttle actuating motor, the throttle position sensor and the air flow sensor are mounted on the throttle body.

5 Claims, 13 Drawing Sheets

FOREIGN PATENT DOCUMENTS

| | | |
|---|---|---|
| JP | 04-353231 | 12/1992 |
| JP | 06-193474 | 7/1994 |
| JP | 2-500677 | 5/1996 |
| JP | 08-170545 | 7/1996 |
| JP | 08-254129 | 10/1996 |
| JP | 08-261023 | 10/1996 |
| JP | 09-032588 | 2/1997 |
| JP | 09-053482 | 2/1997 |

* cited by examiner

THROTTLE APPARATUS FOR AN ENGINE

BACKGROUND OF THE INVENTION

The present invention relates to a throttle apparatus for an engine for electrically performing control for a throttle valve angular position by means of a throttle actuator.

In the recent years, according to advancing of an electronic control for an engine, there has been proposed a technology for controlling an angular position of a throttle valve by detecting a position of an accelerator pedal (accelerator operating rate) by means of an accelerator position sensor and driving a throttle actuator (DC motor, stepping motor and so forth) on the basis of an accelerator position sensor signal and a control signal, such as, a traction control signal and so forth.

Recently, in a system for electrically controlling the angular position of the throttle valve as set forth above, there have been proposed technologies, in which an angular position of the throttle valve at OFF position of an engine key (in other words, while an electric power is not supplied to a throttle actuating motor: initial throttle valve angular position) is set at an angle greater than a minimum angle of the throttle angular position (normally, an idling opening of the throttle valve in a steady state of the engine after warming up) in a control range of the throttle valve angular position, within which the throttle valve angular position is controlled by means of the throttle actuating motor (see PCT National Publication No. 2-500677(1990), Japanese Patent Application Laid-Open No. 3-271528(1991), Japanese Patent Application Laid-Open No. 4-203219(1992), for example).

One reason why the initial opening is set at the foregoing position, is to satisfy a demand for preventing sticking of the throttle valve due to deposition of a viscosity matter, ice or the like. In addition, the initial opening set forth above is intended to assure self-travel (limp home) even upon failure of a throttle control system, and to certainly provide sufficient air flow rate for preventing the engine from stalling.

An initial opening setting mechanism (occasionally referred to as default mechanism) sets a position (close to a fully closed position of the throttle valve) where a spring force of a return spring biasing the throttle valve in a closing direction and a spring force of an initial opening spring for biasing the throttle valve in an opening direction, are balanced, as the initial opening, in principle.

In the throttle apparatus having the initial opening setting mechanism of the type set forth above, when an engine key is turned-on, for example, the throttle valve is mechanically driven from the foregoing initial opening to the minimum point of motor control (position contacting with an adjusting screw) by means of the throttle actuating motor. Thereafter, an angular position of the throttle valve is controlled at a position corresponding to an engine coolant temperature and so forth.

In an engine control portion, sensors, such as an air flow sensor, a throttle position sensor and so forth, have to be provided in an air intake system. When mechanical parts, such as the throttle actuator, gear and so forth are mounted in addition to the foregoing sensors, number of parts can be increased. On the other hand, a space in the engine room is limited.

In an electronically controlled throttle apparatus (hereinafter occasionally referred to as "electronic throttle apparatus"), a technology for aggregating and rationalization of initial opening setting mechanism, such as sensor parts, actuator parts and so forth has been held immature. Therefore, optimal installation technology has been strongly demanded. Particularly, it is typical to provide a body of the air flow sensor and the throttle body, separately. When such prior art is applied to the electronic throttle apparatus, electronic control parts and mechanical parts, such as sensor parts, actuators and so forth, are straggled to increase work load in assembling operation and wiring operation in the case where the throttle apparatus is installed in the engine room. Also, it is not easy to avoid interference between the throttle apparatus and other parts due to limitation of the space in the engine room.

SUMMARY OF THE INVENTION

The present invention has been worked out in view of the drawbacks set forth above.

An object of the present invention is to provide an electronic throttle apparatus which permits aggregating of various parts and rationalization of installation, and can simplify assembling operation and wiring operation to an engine room for rationalization of an installation space.

Another object of the present invention is to guarantee stable operation of a throttle mechanism by a motor control and to enhance accuracy.

The present invention is generally constructed as follows.

At first, the present invention is directed to a mounting technology of a throttle actuating motor, a throttle position sensor and an air flow sensor.

In the first aspect of the present invention, the throttle actuating motor, the throttle position sensor detecting a throttle valve angle, and the air flow sensor located on upstream of the throttle valve and measuring an intake air flow rate are mounted on the throttle body.

With the construction of the foregoing first aspect of the present invention, parts for electronic control can be concentrically arranged on the throttle body. On the other hand, operation for assembling the air flow sensor-body and the throttle body which are otherwise formed separately, in the air intake passage, can be eliminated, so that assembling operation can be completed by single assembling operation of the throttle apparatus. On the other hand, the various external electric wiring such as the sensor output lead wire, the power source wiring, the grounding wiring and so forth can be aggregated on the closer side to the throttle body. Thus, enhancement of efficiency of the wiring connecting operation can be achieved.

In the second aspect of the present invention, in addition to the construction set forth in the first aspect of the invention, the throttle body can be designed to orient an air passage transversely when the throttle body is installed within an engine room, and formed with a casing portion of the motor and a mounting portion of the air flow sensor on an upper surface to be located on an upper side upon installation, among external walls thereof.

With the construction of the second aspect of the present invention as set forth above, the air flow sensor as an accessory of the throttle apparatus, can be taken out from the throttle body independently and easily, even after installation of the throttle body within the engine room for enhancing convenience in inspection, maintenance and exchanging. On the other hand, since the motor casing portion extends over the upper surface of the throttle body, a step is formed between the motor casing portion and the upper surface of the remaining throttle body. A space defined by the step can be effectively utilized as an installation space of the air flow sensor. Therefore, wasting of space around the throttle body can be eliminated to increase density of concentration in mounting of the parts.

In the third aspect of the present invention, in addition to the construction set forth in the first aspect of the invention, directionality of connector terminals for electrical connection with external electric wiring of the throttle actuating motor, the throttle position sensor and the air flow sensor can be matched with each other.

Various external electric wiring (sensor output line, the sensor power line, the motor line and so forth) can be lead from the engine control unit to the throttle body. Since the connector terminals of electrical connection for the external electrical wiring of the throttle actuating motor, the throttle position sensor, the air flow sensor are matched directionality so that various electric wiring are not required to be lead from different directions to make operation for establishing electrical connection quite simple.

As an optimum embodiment, according to the fourth aspect of the present invention, the throttle body may be designed to orient an air passage transversely when the throttle body is installed within an engine room, and the throttle actuating motor and a circuit module of the air flow sensor being mounted on an upper surface to be located on an upper side upon installation, among external walls the throttle body, directionality of connector terminals for electrical connection with external electric wiring of the throttle actuating motor and the air flow sensor may be matched with each other, and the throttle position sensor may be arranged on a side surface of an external wall of the throttle body on the side, toward which the connector terminals for electrical connection with external electric wiring of the throttle actuating motor and the air flow sensor are directed, and directionality of a connector terminal for electrical connection with an external electrical wiring of the throttle position sensor being consistent with those of the connector terminals for electrical connection with external electric wiring of the throttle actuating motor and the air flow sensor. With this construction, the effects to be achieved in the foregoing second and third aspects of the present invention can equally achieved.

Also, according to the fifth aspect of the present invention, a throttle body includes a throttle valve and a throttle actuating motor, and a throttle position sensor mounted on an external wall of the throttle body, and directionality of a connector terminal for electrical connection of the throttle position sensor with an external electric wiring and a connector terminal for electrical connection of the throttle actuating motor are matched with each other. Thus, connecting operation of various electric wiring can be further simplified.

In the sixth aspect of the present invention, in addition to the construction employed in the foregoing fifth aspect of the present invention, a connector terminal for electrical connection of the throttle position sensor with an external electric wiring and a connector terminal for electrical connection of the throttle actuating motor are aggregatingly housed within a sensor casing with matching directionality thereof, and a mounting portion of the throttle position sensor being covered with a resin cover, and a female connector casing for introducing the aggregated connector terminals within the sensor casing, is formed in a part of the resin cover.

With the construction in the foregoing sixth aspect of the present invention, since the connector terminals of the throttle position sensor and the connector terminals of the throttle actuating motor may be aggregatingly provided in the female type connector casing provided in the sensor cover of the synthetic resin which covers the sensor casing, the connector portion (connector casing) can be concentrated. Correspondingly, the external electric wiring of the throttle position sensor and the external electric wiring of the throttle actuating motor can be aggregated to be concentrically terminated to the connector portion (male connector casing). Thus, connecting operation of the electric wiring can be performed by simply mating the male connector and the female connector.

It is expected that the different shapes of the connector casings of the electrical wiring are used in respective of makers. Even in such case, the sensor casing of the throttle position sensor may be used as is and it is only required to exchange the resin sensor cover to one having the connector casing adapted to the shape of the male connector on the electric wiring. Therefore, the throttle position sensor may be common to respective makers to improve compatibility of the parts.

In addition to the foregoing sixth aspect, in which the connector terminal for electrical connection of the throttle position sensor with an external electric wiring and the connector terminal for electrical connection of the throttle actuating motor are aggregatingly housed within a sensor casing with matching directionality thereof, in consideration of convenience of wiring operation within the throttle body of the terminal directly mounted on the throttle actuating motor and the connector terminal, a construction, in which a motor casing of the throttle actuating motor is integrally formed with the throttle body, a power input terminal directly mounted on the throttle actuating motor housed within the motor casing, is located in a mounting portion of the throttle position sensor, and a rear end of the connector terminal for electrical connection of the throttle actuating motor is connected to the power input terminal directly mounted on the throttle actuating motor via a connector with a lead wire, has been proposed as the seventh aspect of the present invention.

As the eighth aspect of the present invention, as an alternative of the seventh aspect of the present invention as set forth above, the throttle apparatus for an engine comprises:

a throttle body including a throttle valve and a throttle actuating motor; and a throttle position sensor mounted on an external wall of the throttle body, a connector terminal for electrical connection of the throttle position sensor with an external electric wiring and a connector terminal for electrical connection of the throttle actuating motor being aggregatingly housed on a surface side of a sensor casing, a connector terminal to be connected with a power input terminal directly mounted on the throttle actuating motor, being arranged on a backside of the sensor casing, a motor casing of the throttle actuating motor being integrally formed with the throttle body, a power input terminal directly mounted on the throttle actuating motor housed within the motor casing, being located in a mounting portion of the throttle position sensor; and the power input terminal directly mounted on the throttle actuating motor and the connector terminal provided on back side of the sensor casing having a terminal structure for direct engagement upon installation of the sensor casing on an external wall of the throttle body.

With the construction set forth above, the external electric wiring to be connected to the throttle position sensor and the throttle actuating motor within the engine room can be connected with a single connector portion on (the surface side of the casing of the throttle position sensor) of the throttle body. Also, even when the throttle position sensor 32 is mounted on the throttle body 1 before installation within the engine room, the connector terminal corresponding to the throttle actuating motor provided on the backside of the sensor casing can be mated with the power input terminal directly mounted on the throttle actuating motor within the sensor mounting space, at one action to successfully simplify connection of electrical wiring on the inside or outside of the throttle body.

In the ninth aspect of the present invention, similar to the foregoing eighth aspect of the invention, there has been proposed a construction, in which a connector terminal to be connected with a power input terminal directly mounted on the throttle actuating motor, being arranged on a backside of the sensor casing, and the power input terminal directly mounted on the throttle actuating motor and the connector terminal provided on back side of the sensor casing being directly (without lead wire) connected via a sleeve joint.

Even with the construction set forth above, the similar function and effect to the achieved by the foregoing eighth aspect can be achieved.

In consideration of facilitating of mounting the following construction is proposed for the throttle actuating motor in the tenth aspect of the present invention, that a throttle apparatus for an engine comprises:

a throttle valve and a throttle actuating motor mounted on a throttle body of an air intake system of the engine;

a motor casing for the throttle actuating motor being formed integrally with the throttle body, which motor casing defines a tapered hole gradually increasing a diameter from a bottom side end to an opening side end and has a diameter greater than an outer diameter of the throttle actuating motor, an end cover with a flange being provided on the throttle actuating motor at an end portion on the opening side, the throttle actuating motor being set within the motor casing with extending the end cover therefrom, and a stopper being provided in the throttle body for contacting with an outer periphery of the flange of the end cover in order to prevent rattling.

With the construction in the tenth aspect of the present invention, the throttle actuating motor can be smoothly increased into the motor casing portion in the throttle body. Furthermore, even when a gap is formed between the inner diameter on the opening side of the motor insertion opening and the outer diameter of the throttle actuating motor, rattling of the throttle actuating motor in the radial direction can be successfully prevented by contacting the outer periphery of the flange of the end cover of the throttle actuating motor projected from the motor casing portion with the inner periphery of the stoppers. It should be noted that the diameter of the motor casing on the bottom side is substantially the same as the outer diameter of the rear side of the throttle actuating motor so as not to cause rattling.

On the other hand, in the eleventh aspect of the present invention, in consideration of easiness of mounting of the throttle valve and the throttle actuating motor on the throttle body in the air intake system of the engine, there is proposed throttle apparatus for an engine comprising:

a throttle body in an air intake system of the engine;

a throttle valve and a throttle actuating motor housed in the throttle body;

a receptacle portion for receiving a gear mechanism for transmitting a driving force of the throttle actuating motor to the throttle shaft, being formed on one surface of an outer wall of the throttle body;

a gear cover covering the receptacle portion of the gear mechanism;

a receptacle casing provided on the inner surface of the gear cover for receiving a volute return spring biasing the throttle shaft in a valve closing direction;

one end of the throttle shaft being extended to the receptacle portion of the return spring of the gear cover to be coupled with the return spring at the one end.

With the construction set forth above, since the volute spring is employed as the return spring, down-sizing of the spring can be achieved. Furthermore, since the return spring is housed within the spring casing formed in the gear cover, when the gear cover is set in the throttle body, the return spring can be set simultaneously. Thus, assembling of the parts can be simplified to make assembling operation efficient.

Also, in the twelfth aspect of the present invention, in consideration of easiness of mounting of the initial opening setting mechanism, there is proposed a throttle apparatus for an engine which comprises:

a throttle body in an air intake system of the engine;

a throttle valve, a throttle actuating motor and a return spring applying a force on a throttle shaft in a throttle valve closing direction housed in the throttle body;

a throttle control system for controlling an angular position of the throttle valve by controlling the throttle actuating motor on the basis of an electric control signal; and an initial opening setting mechanism for maintaining an initial opening of the throttle valve to be greater than a minimum opening position in a motor control within a throttle valve control range while an electric power is not supplied to the throttle actuating motor, the initial opening setting mechanism including a lever for setting the initial opening arranged on the throttle shaft for rotation therewith, a member receiving the lever when the throttle valve is displaced in a valve closing direction up to a predetermined position and an initial opening setting spring for applying a force in a valve opening direction on the throttle shaft in order to maintain the initial opening of the throttle valve against the force of the return spring, the lever receiving member and the initial opening setting spring being housed within a cylindrical portion provided on the wall portion of the throttle body together with an adjuster screw, the lever receiving member projecting a part from the cylindrical portion for receiving the lever, the initial opening setting spring being disposed between the lever receiving member and the adjuster screw for permitting a spring force by the adjuster screw.

In the construction set forth above, the lever may be formed with a sectorial throttle gear provided on the throttle shaft among a gear mechanism transmitting a driving force of the throttle actuating motor.

With the construction set for above, in the state where the engine key is turned OFF (electric power is not supplied to the throttle actuating motor), the lever for setting the initial opening providing on the throttle shaft contacts with the lever receiving member on the throttle body before the throttle valve is displaced to the fully closed position, by the spring force of the return spring of the throttle valve. Since the lever receiving member is preliminarily biased in the valve opening direction by the spring force of the spring for setting the initial opening. Therefore, the initial opening (initial opening>motor controlled minimum opening) is determined by a balance of the spring forces of the spring for setting of the initial opening and the return spring.

The initial opening can be set at arbitrary angular position by adjusting the spring force of the spring for setting the initial opening by means of the adjuster screw. On the other hand, by driving the throttle actuating motor, the lever receiving member (placed in the position depressed onto the lever of the throttle shaft) can be shifted to abut with the adjuster screw from the initial opening position against the spring force of the spring for setting the initial opening. The position where the lever receiving member contacts with the adjuster screw is the minimum mechanical opening of the throttle valve. In this sense, the adjuster screw functions as the fully closed position stopper.

The initial opening setting mechanism is constructed by only proving the lever (if the lever is integral with the throttle gear, the gear parts may be used as replacement of the parts mounted on the throttle shaft in the initial opening setting mechanism). In the throttle body, it is only required to receive the adjuster screw, the initial opening setting spring and the lever receiving member within the cylindrical portion at only one portion. Furthermore, since the adjuster screw may also be used for adjustment of spring force of the initial opening setting spring as the stopper for determining the minimum mechanical opening position of the throttle valve. Thus, number of parts can be reduced.

Also, in the thirteenth aspect of the present invention, in view of reduction of pressure loss in the air intake passage, there is proposed a throttle apparatus for an engine comprising:

a throttle body of an air intake system of the engine;

a throttle valve and a throttle actuating motor housed within the throttle body;

a throttle control system for controlling an angular position of the throttle valve by controlling driving of the throttle actuating motor on the basis of an electric control signal;

assuming that an opening is 0° when the throttle valve is positioned to be perpendicular with an air intake passage and that an opening is 90° when the throttle valve is positioned in parallel to an axis of the air intake passage, a movable stopper element provided on the throttle shaft being in contact with a stationary stopper element for defining a maximum opening provided on the throttle body for setting a maximum mechanical opening physically preventing further displacement of the throttle valve thereover at an angle greater than or equal to 90°, and a maximum opening of the throttle valve as controlled by the throttle actuating motor being set at 90°.

In the conventional throttle apparatus, the motor controlled maximum opening of the throttle valve is set to be smaller than 90° (e.g. 86°). By this, even at the maximum opening as controlled by the motor, the intake air collides on the surface of the throttle valve to serve as a resistance in the air intake passage to cause the pressure loss.

In contrast to this, in the present invention, by setting the motor controlled maximum opening of the throttle valve at 90°, the throttle valve at the maximum opening position becomes substantially parallel to the intake air flow to reduce flow resistance in the air intake passage to restrict the pressure loss.

On the other hand, by setting the maximum mechanical opening over which the throttle valve cannot be driven physically for abutting the movable stopper element on the throttle shaft onto the stationary stopper element on the throttle body, to be greater than or equal to 90°, and under this condition, the maximum opening of the throttle valve as controlled by the throttle actuating motor is set at 90° so that the motor controlled maximum opening can be set accurately without causing dimensional tolerance. Furthermore, it becomes possible to avoid collision of the movable stopper element provided on the throttle shaft and the stationary stopper element on the throttle body at the maximum opening of the throttle valve as controlling the throttle actuating motor to preventing wearing and damaging of the stopper in the long time use.

DESCRIPTION OF THE PREFERRED EMBODIMENT

The preferred embodiments of a throttle apparatus for an engine according to the present invention will be discussed hereinafter with reference to the drawings.

Figure 1:
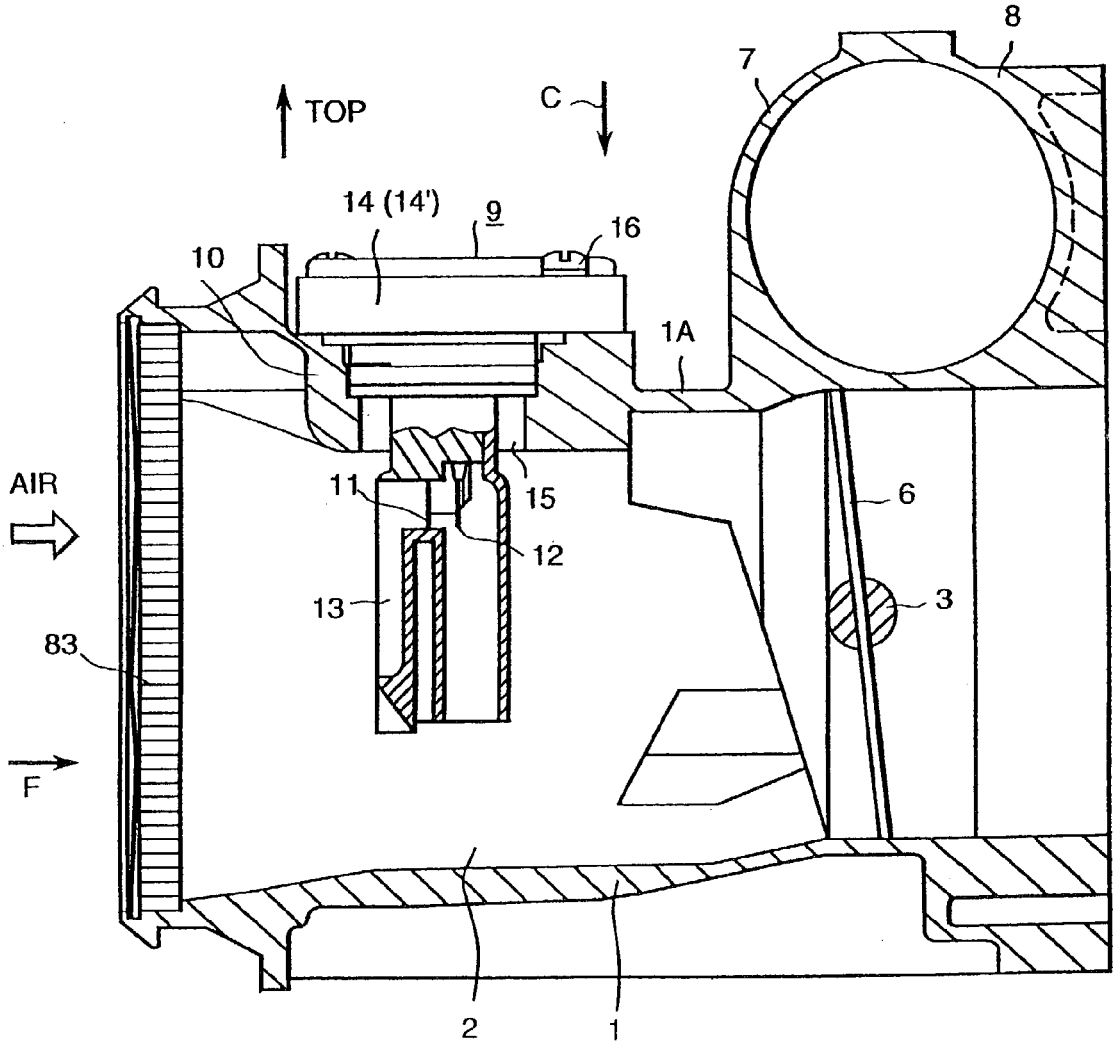
FIG. 1 is a sectional front elevation of one embodiment of a throttle apparatus according to the present invention, sectioned along line B—B of FIG. 3 discussed later.
Figure 2:
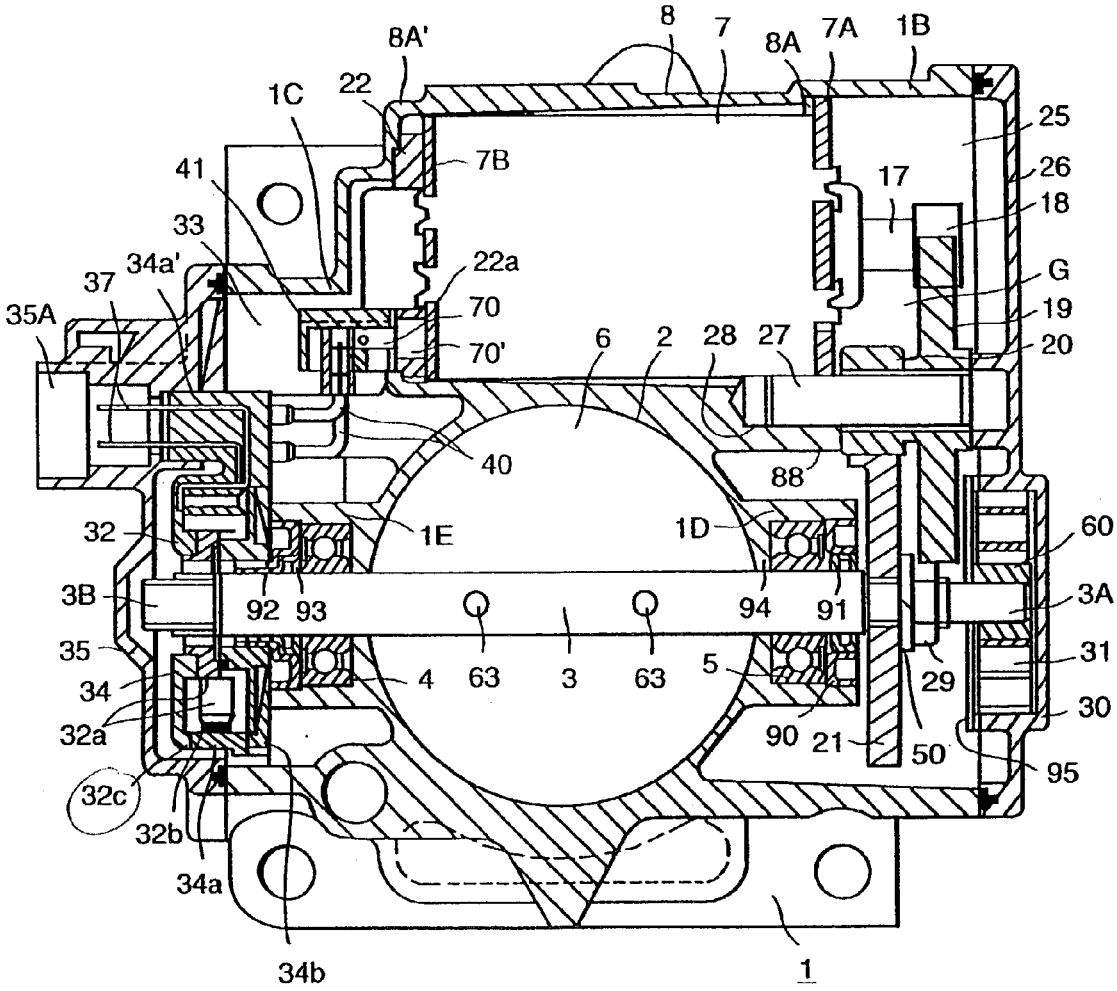
FIG. 2 is a section taken along line A—A of FIG. 2.
Figure 3:
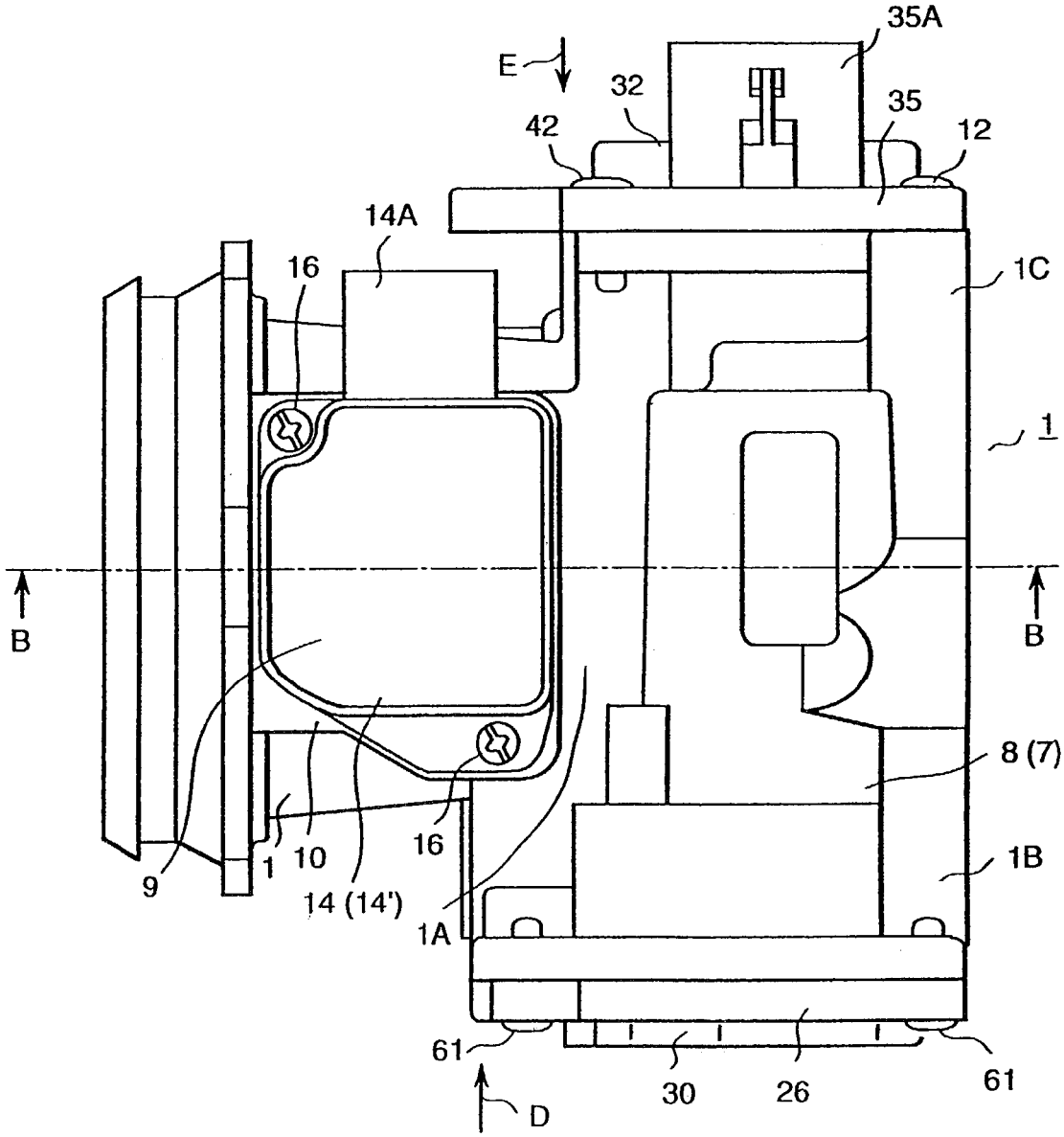
FIG. 3 is a plan view of one embodiment of the throttle apparatus according to the present invention as viewed along an arrow C in FIG. 1.
Figure 4:
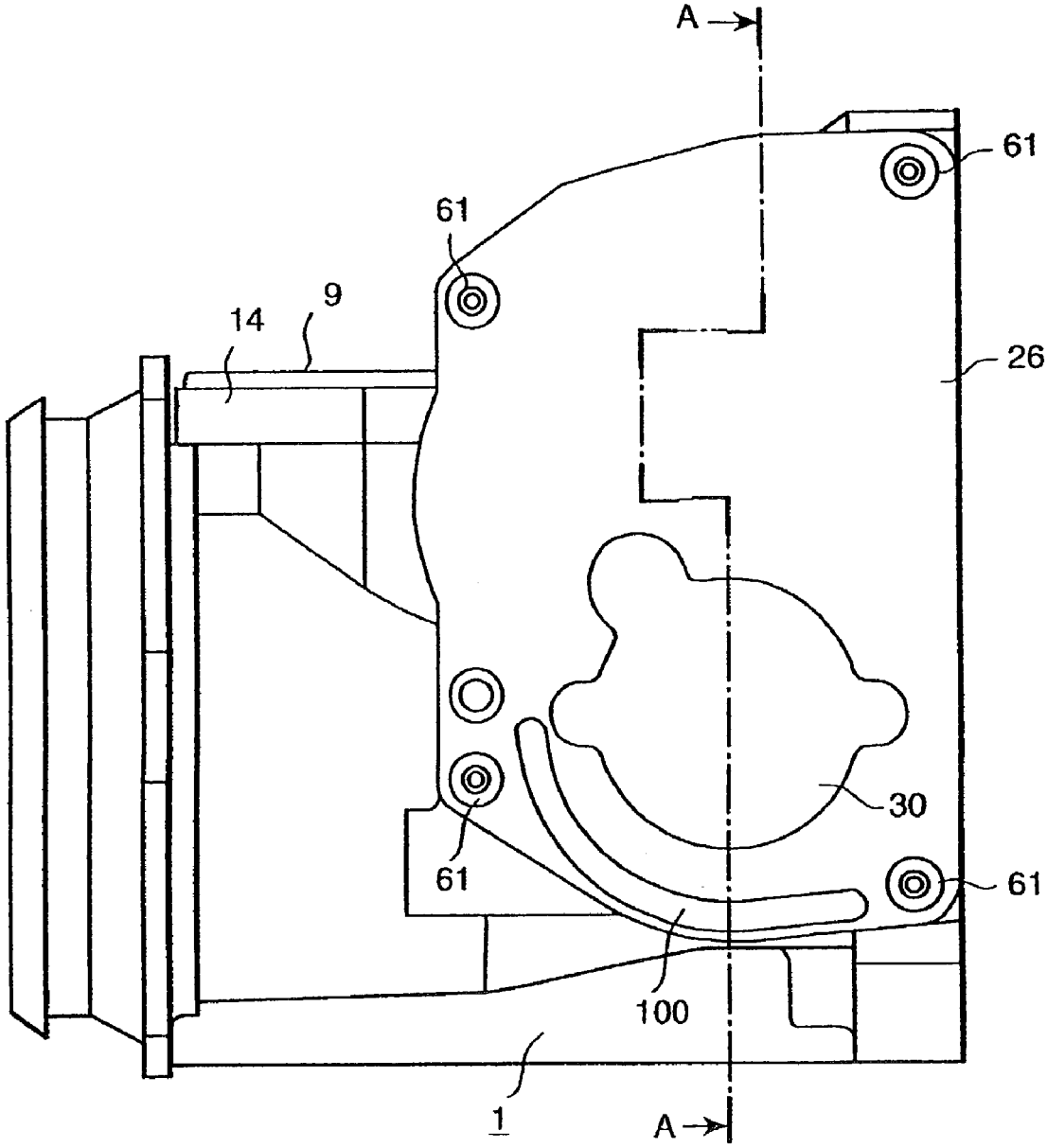
FIG. 4 is a front elevation of one embodiment of the throttle apparatus according to the present invention as viewed along an arrow D in FIG. 3.
Figure 5:
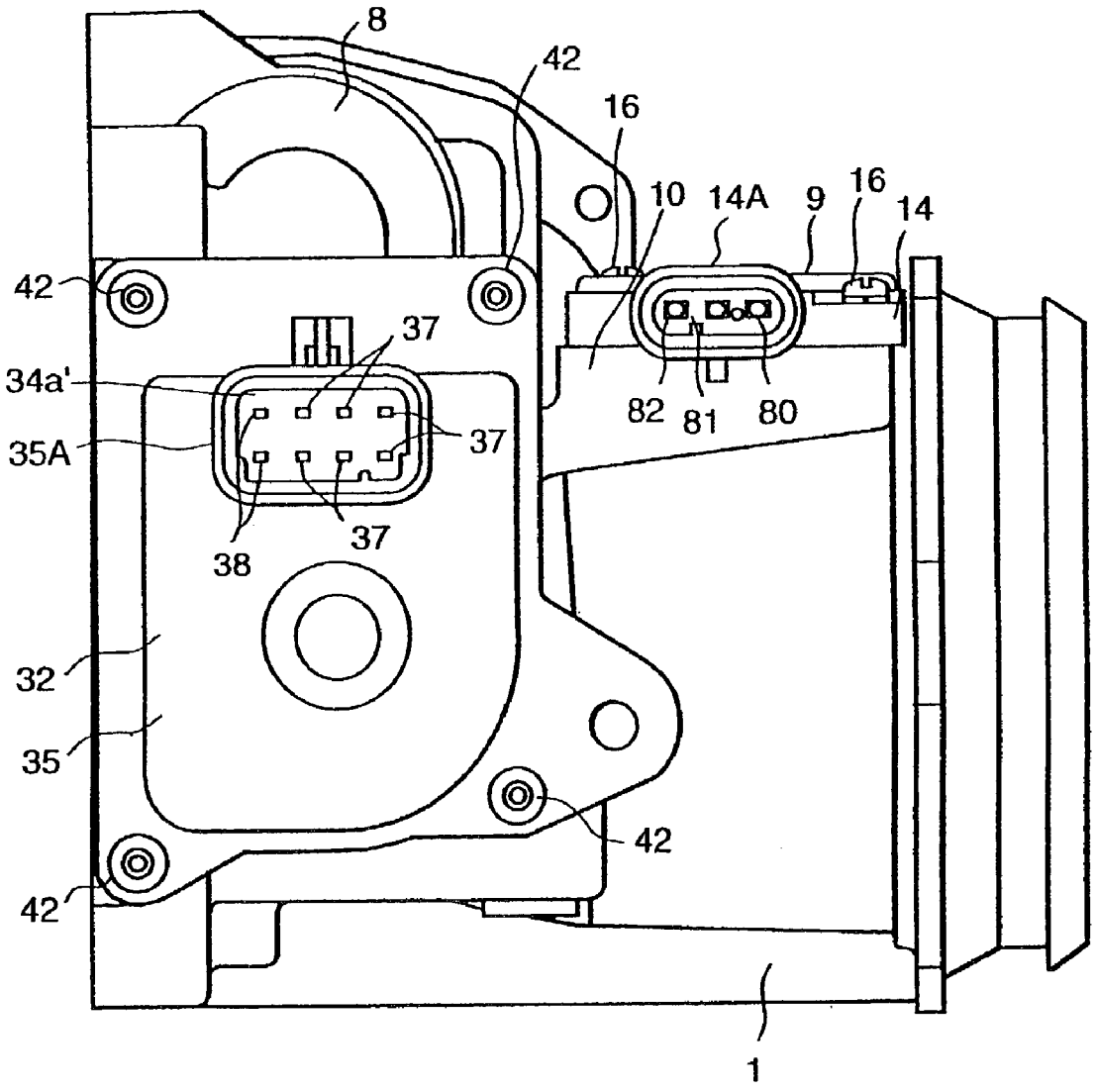
FIG. 5 is a back elevation of one embodiment of the throttle apparatus according to the present invention as viewed along an arrow E in FIG. 3.
Figure 6:
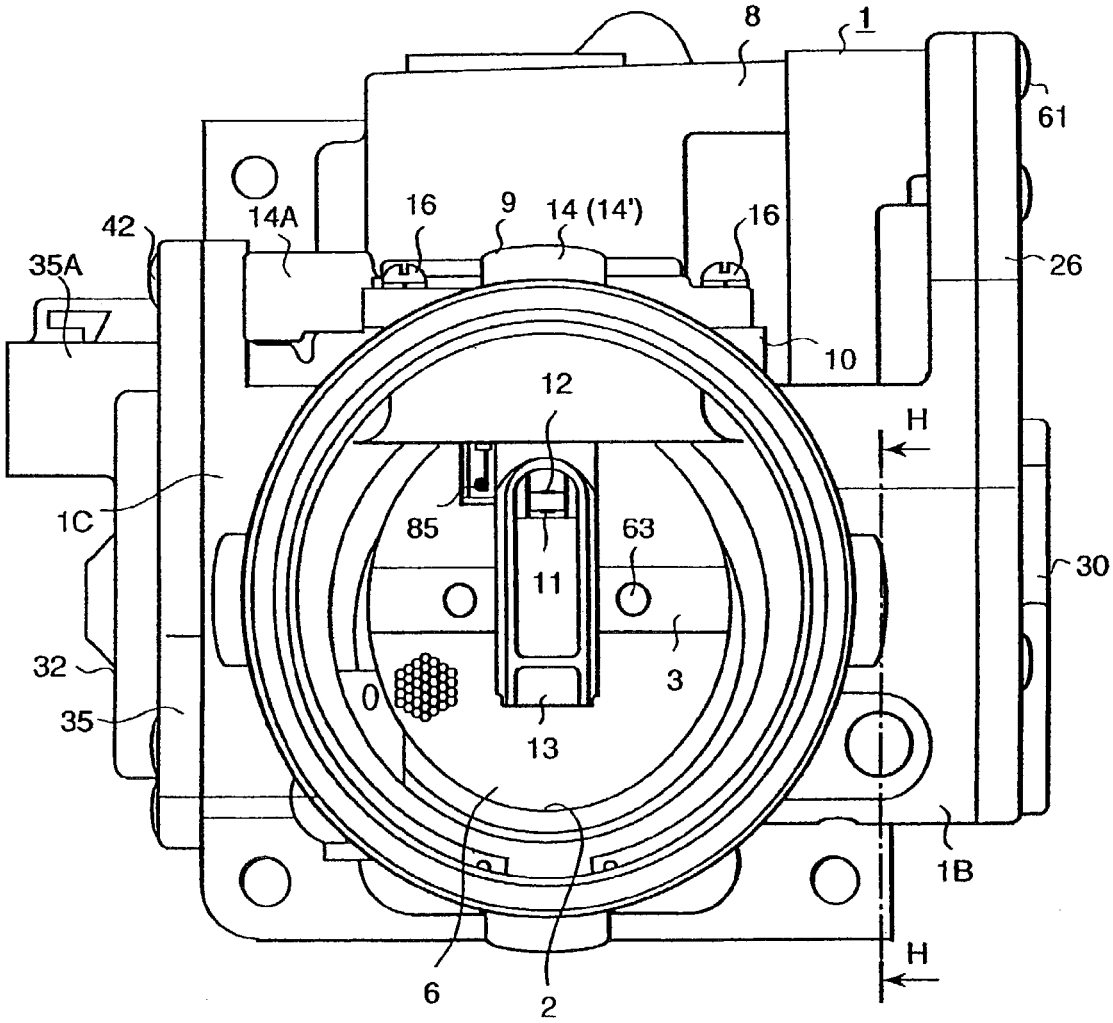
FIG. 6 is a left side elevation of one embodiment of the throttle apparatus according to the present invention as viewed along an arrow F in FIG. 1.
Figure 7:
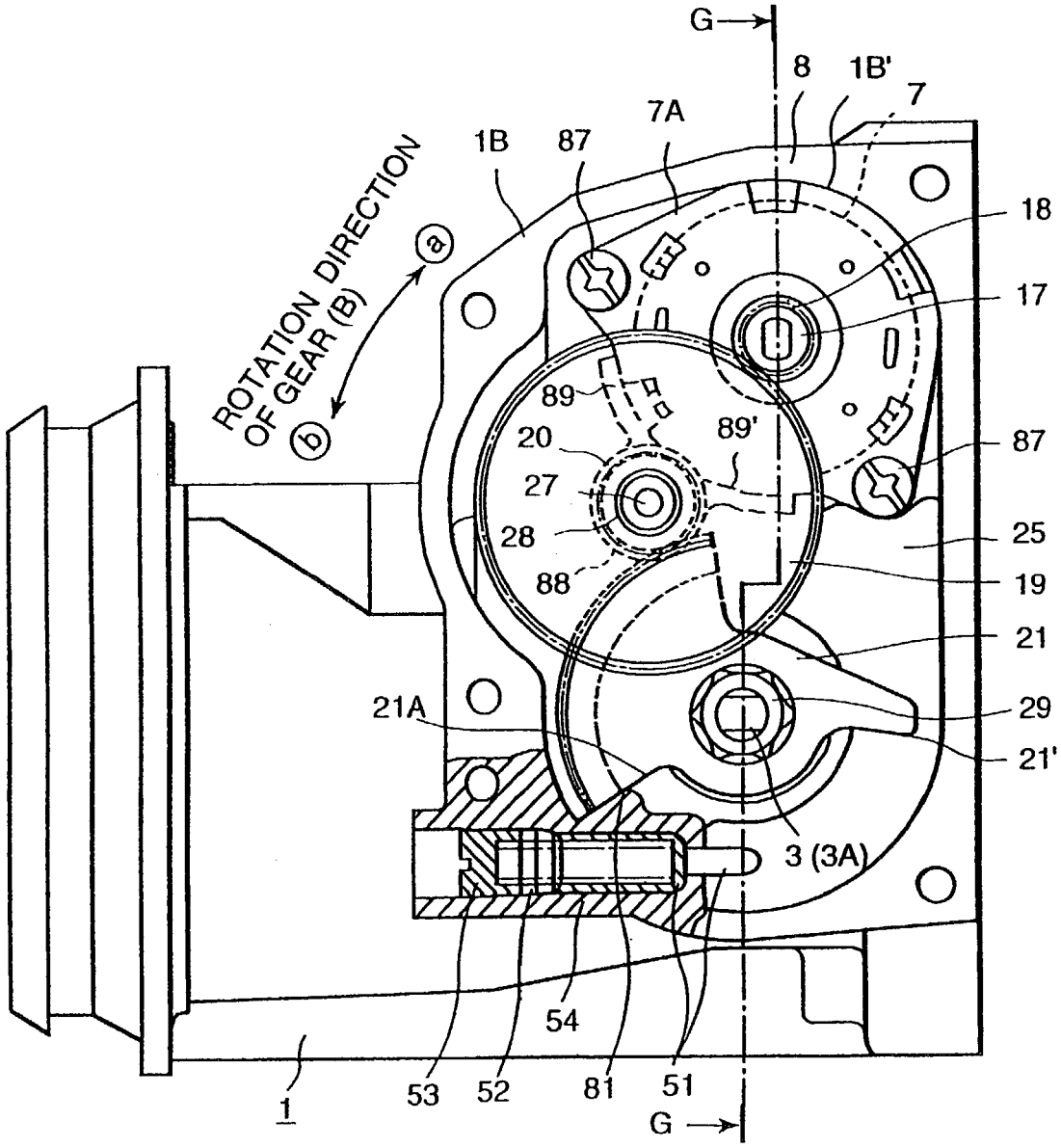
FIG. 7 is a front elevation similar to FIG. 4 but showing in a form where a gear cover is removed.
Figure 8:
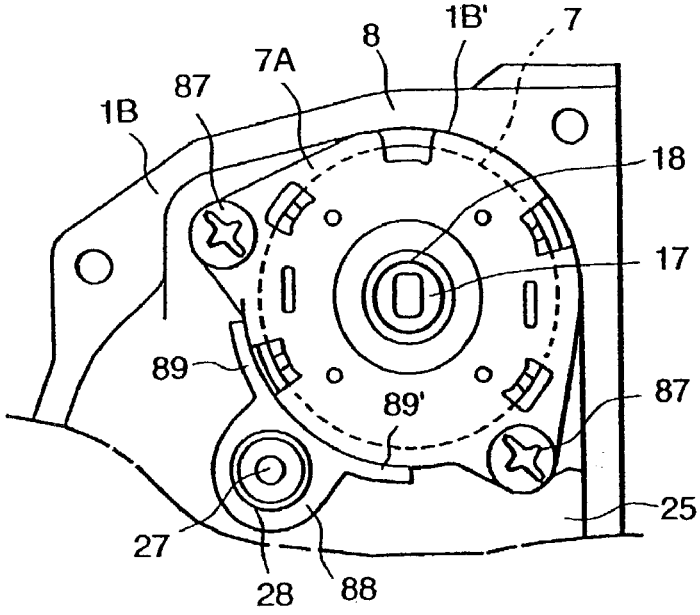
FIG. 8 is a partially sectioned front elevation similar to FIG. 7 but showing in a form where intermediate gears of a gear mechanism of the throttle apparatus are removed.
Figure 10:
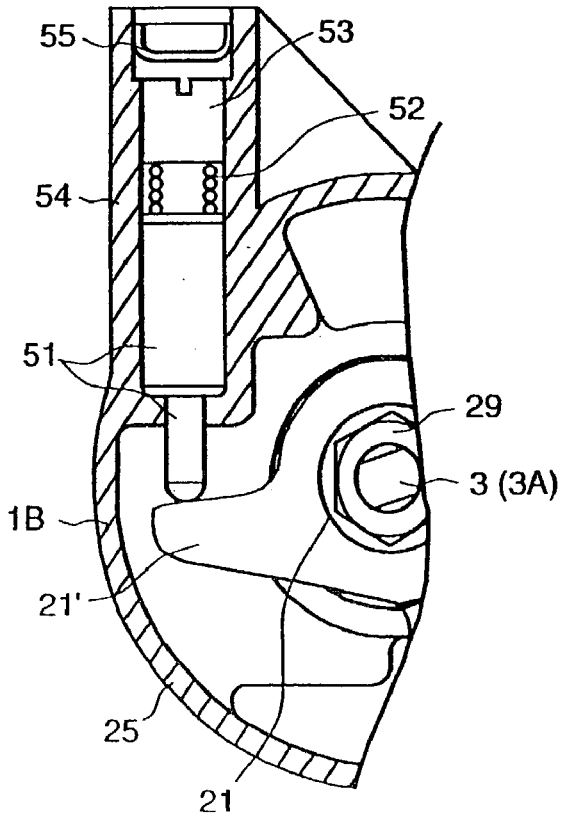
FIG. 10 is a section taken along line H—H of FIG. 6.
Figure 9:
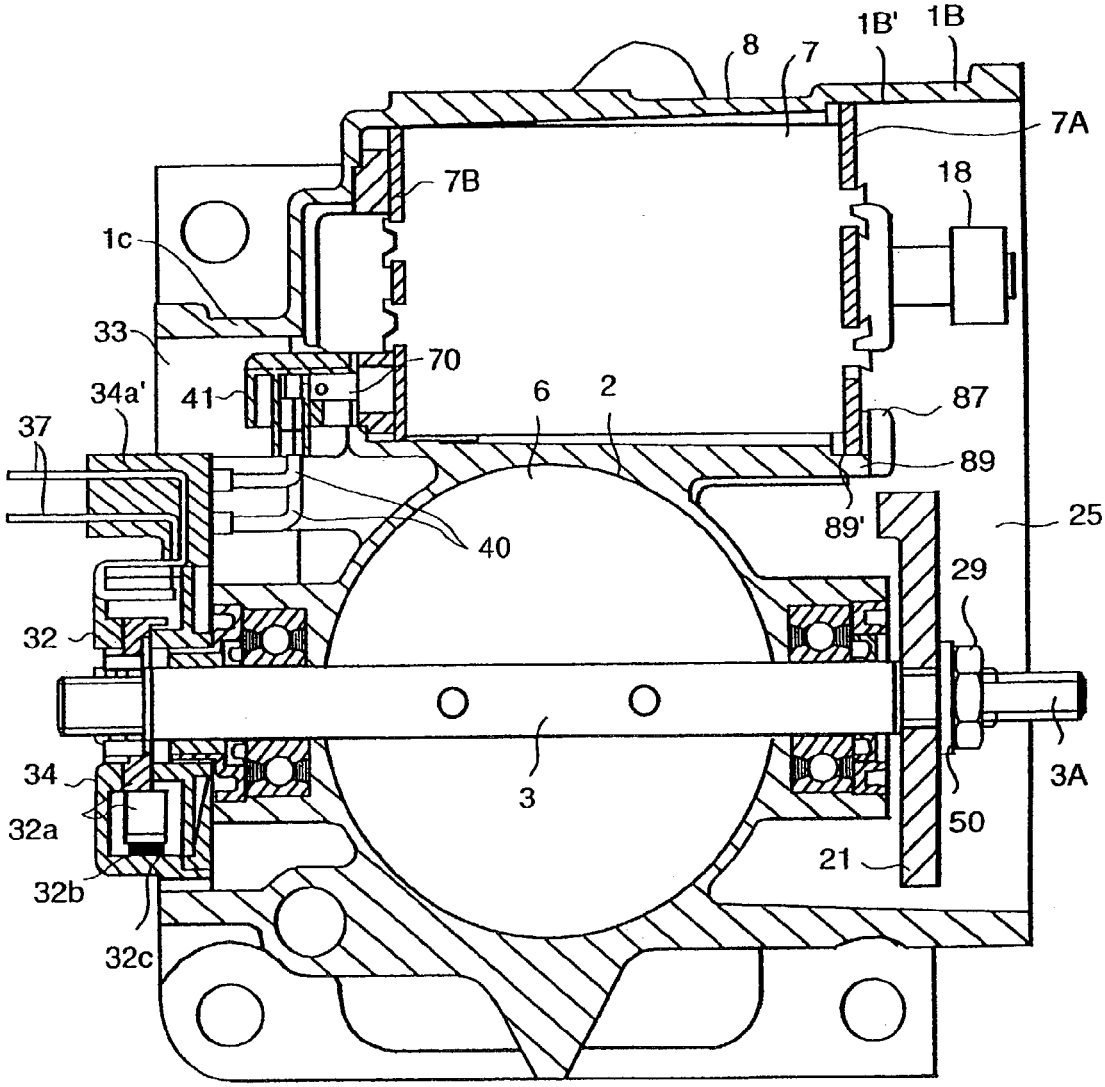
FIG. 9 is a section taken along line G—G of FIG. 7 which is illustrated with removing a part of the gear mechanism of the throttle apparatus and the gear cover.
Figure 11:
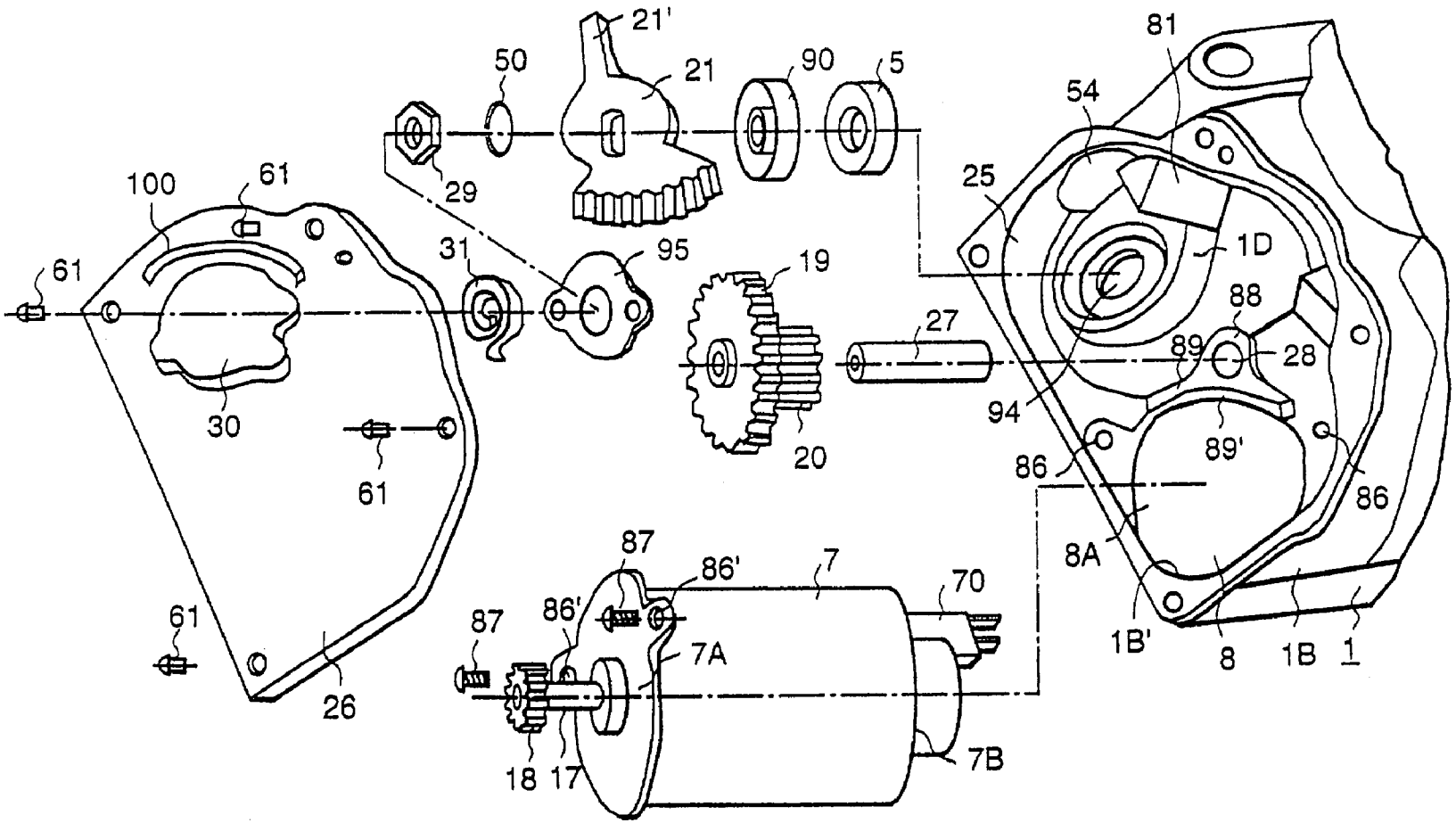
FIG. 11 is an exploded perspective view including a gear mechanism of a throttle actuator.
Figure 12:
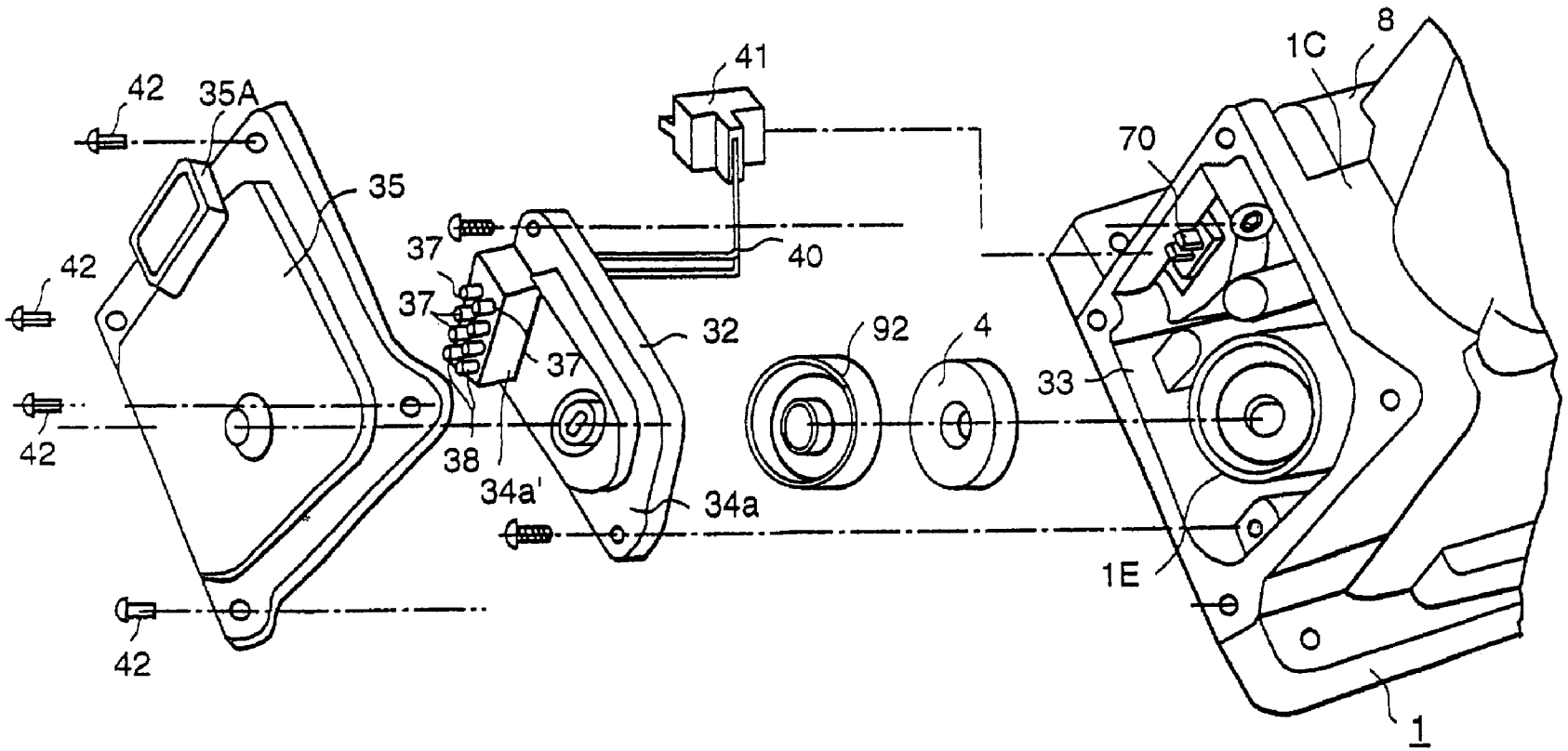
FIG. 12 is an exploded perspective view of a throttle position sensor.
Figure 14:
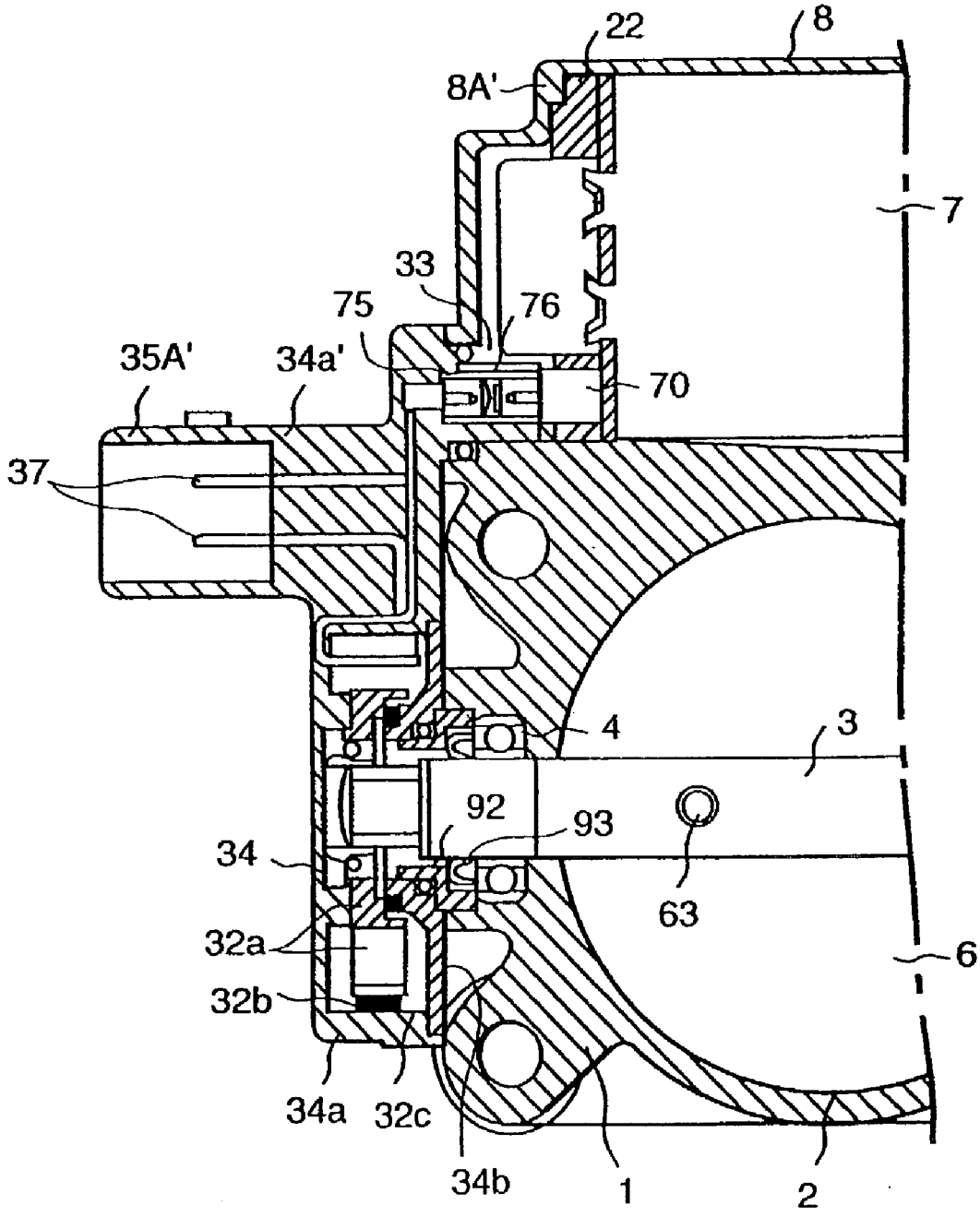
FIG. 14 is a partial section showing another embodiment of the throttle apparatus according to the present invention.

FIG. 1 is a sectional front elevation showing one embodiment of a throttle apparatus according to the present invention (a section taken along line B—B of FIG. 3), FIG. 2 is a section taken along line A—A of FIG. 4, FIG. 3 is a view (plan view) as viewed along an arrow C of FIG. 1, FIG. 4 is a view (front elevation) as viewed along an arrow D of 25 FIG. 3, FIG. 5 is a view (front elevation) as viewed along an arrow E of FIG. 3, FIG. 6 is a view (left side elevation) as viewed along an arrow F of FIG. 1, FIG. 7 is a front elevation illustrated with removing a gear cover 26 of FIG. 4, FIG. 8 is a partial front elevation as viewed with removing intermediate gears 19 and 20 of a throttle gear mechanism in FIG. 7, FIG. 9 is a section taken along line G—G of FIG. 7 illustrated with removing a part of a gear mechanism of the throttle and the gear cover, FIG. 10 is a section taken along line H—H of FIG. 6, FIG. 11 is an exploded perspective view including a gear mechanism of a throttle actuator, FIG. 12 is an exploded perspective view of a throttle position sensor, FIG. 14 is an explanatory illustration showing a control range of a throttle valve angular position, and FIG. 14 is a partial section showing another embodiment of the throttle apparatus according to the present invention.

In the drawings, a throttle body 1 is formed by aluminum die-casting, for example, and is formed with an air intake passage (bore) 2 therein. In the throttle body 1, a throttle shaft 3 is extended perpendicularly to the air intake passage 2 and rotatably supported on bearings 4 and 5. On the throttle shaft 3, a throttle valve 6 for controlling an intake air flow rate in the air intake passage 2 is mounted by means of screws 63. Adjacent the bearings 4 and 5 of the throttle shaft, seals 91 and 93 and seal retainers 90 and 92 are provided.

The throttle body 1 is provided with a motor casing portion 8 of a throttle actuating motor 7 (hereinafter referred to as "motor casing portion") and a mounting portion 10 of an air flow sensor 9 on an upper surface, namely an upper surface 1A of an external wall of the throttle body to be placed at upper side as installed within an engine room. On the upstream side of the throttle valve 6, the throttle body 1 is extended to certainly provide a space for forming a mounting portion 10 of an air flow meter 9.

In the shown embodiment, a known hot wire type air flow sensor utilizing a hot wire is employed as the air flow sensor 9, for example. In the shown embodiment, a heating element (hot wire) 1 for measuring an intake air flow rate, a heat sensitive element (cold wire) 12 for temperature compensation, a measuring passage of a bent passage for introducing a part of an intake air in the air intake passage 2, in which the heating element 11 and the heat sensitive element 12 are disposed, and a sensor circuit module 14 are integrated. The measuring passage 13 is inserted through a through opening 15 formed in a side wall of the throttle body 1 in a direction perpendicular to an axial direction of the throttle body 1 and is arranged within the bore 2 of the throttle body 1. The circuit module 14 is located on an external wall surface of the throttle body and fixed by means of screws 16.

In an upstream side opening of the throttle body 1, a honeycomb shaped grating 83 for regulating the intake air is mounted.

On a part of casing (air flow sensor casing) 14' of the circuit module 14, a connector 14A for establishing electrical connection with a not shown external electric wiring is formed integrally with the casing 14', orienting sidewardly (see FIGS. 3, 5 and 6). As shown in FIG. 5, in the connector 14A, a sensor power supply terminal 80, a grounding terminal 81 and a sensor output terminal 82 are disposed.

An air flow rate indicative signal output from the air flow sensor 9 is fed to a not shown engine control unit to be used for calculation of a fuel injection amount for an engine control. It should be noted that the reference numeral 85 in FIG. 6 denotes an air temperature measuring element to be used for engine control.

The motor casing portion 8 is arranged with orienting an axial direction thereof in parallel to a throttle shaft 3. As the motor 7 housed within the motor casing portion 8, a direct current motor, a stepping motor and so forth may be used, for example. A driving force of the motor 7 is transmitted to the throttle shaft 3 via a gear mechanism G consisted of gears 18, 19, 20 and 21, as shown in FIGS. 2 and 7.

As shown in FIG. 2, the motor casing portion 8 is formed into a cylindrical form and has an opening 8A for inserting a motor 7 on the side mating with a gear receptacle portion of the gear mechanism G. The motor casing portion 8 has a diameter substantially the same as an external diameter of the motor 7 at an end portion 8A' on opposite side of the motor insertion opening 8A side (contra-motor insertion side: bottom portion of casing) and is a tapered shape gradually increasing the internal diameter toward the motor insertion opening 8A from the end 8A' of the casing. Thus, by widening the opening end of the casing to has greater internal diameter than the external diameter of the motor, insertion of the motor 7 is facilitated.

An elastic member 22 is disposed between an inner surface of the end portion 8A' on contra-motor insertion side of the motor casing portion 8 and one end of the motor 7 (a rear side end cover 7B). On the other hand, as shown in FIGS. 7, 8 and 11, a front side end cover 7A of the motor 7 has a flange. The end cover 7A with the flange is extended from the motor insertion opening 8A so that threaded holes 86' formed in the flange (see FIG. 11) and threaded holes 86 formed in a gear receptacle portion 25 if the throttle body 1 are engaged with screws 87 for directly fixing the motor 7 on the throttle body 1. In the elastic member 22, an engaging hole 22*a* through which a power input terminal 70 directly mounted on the motor are extended to engage with the for engaging with a terminal base 70', is formed.

As shown in FIGS. 7, 8 and 11, on a peripheral edge of an opening of a gear shaft mounting hole (mounting hole of the gear shaft 27 supporting intermediate gears 19 and 20) 28, a boss portion 88 is provided. An arc-shaped projection 89 is formed integrally with the boss portion 88. The arc-shaped projection 89 is formed along an opening edge of the motor casing portion 8 so that the end cover 7A with the flange on the front side of the motor is extended from the motor insertion opening 8A and the inner periphery 89' of the projection 89 is complementarily contact with a part of the outer periphery of the end cover 7A, upon installation of the motor 7 in the motor casing portion 8. On the other hand, among a cylindrical wall 1B forming the receptacle portion 25 of the gear mechanism G, a inner periphery of the cylindrical wall 1B on the side opposing to the arc-shaped projection 89 is also designed to complementarily contact with a pair of the outer periphery of the flange of the end cover 7A. By these opposing inner peripheries 89' and 1B', diametrical rattling of the motor 7 can be prevented (see FIGS. 7, 8 and 9).

As shown in FIGS. 2, 7 and 11, the gear receptacle portion 25 of the gear mechanism G is provided in the wall surface mating with one end 3A side of the throttle shaft 3, among the external wall of the throttle body 1. The gear receptacle portion 25 of the gear mechanism G is certainly provided by extending the cylindrical wall 1B from one surface of the external wall of the throttle body 1. As shown in FIGS. 3 and 11, the opening end of the gear receptacle portion 25 is covered with a gear cover 26 fixed on the throttle body 1 by means of an appropriate fastening means 61, such as a rivet, screw and so forth. The gear cover 26 is formed of a synthetic resin, for example. The a sleeve form boss portion (bearing box) lD of one of the bearing 5 of the throttle shaft 3 is also arranged within the cylindrical wall 1B. In the boss portion 1D, a throttle shaft insertion hole 94 is formed.

Among gears in the gear mechanism G, the gear (pinion) 18 is rigidly fixed on the shaft 17 of the motor. The intermediate gear 19 meshing with the gear 18 has greater gear ratio than the gear 18 for achieving speed reduction and increasing of torque. The increased revolution torque is transmitted to the throttle shaft 3 via the intermediate gear 20 and a gear (throttle gear) 21.

The intermediate gears 19 and 20 are integrally formed and engaged with a gear supporting shaft 27 for free rotation thereabout. One end of the gear supporting shaft 27 is press fitted into a gear mounting hole 28 provided in the side wall of the throttle body 1. The other end of the gear supporting shaft 27 is engaged on the inner side of the gear cover 26. In order to prevent the intermediate gears 19 and 20 from loosing off, the intermediate gears 19 and 20 are held by the gear cover 26 via a nylon washer.

The throttle gear 21 is abutted on a stepped portion at one end of the throttle shaft 3 and is secured via a washer 50 by tightening of a nut 29. As the throttle gear 21, a sector gear may be employed, for example.

In the shown embodiment, the throttle apparatus is a full electronic control type which does not use an accelerator wire. By a driving force of the throttle actuating motor 7 of a throttle control system, a rotational torque is applied to the throttle shaft 3 via the gears 18, 19 20 and 21.

To the throttle actuating motor 7, a driving current is supplied to a not shown throttle control module (hereinafter referred to as TCM). The TCM generates a driving current command value in the following manner. By inputting an accelerator position signal from a not shown accelerator position sensor, a throttle angular position indicative signal from the throttle position sensor 32, an engine revolution speed, a slip signal and so forth, the driving current command value depending upon an operational mode of the engine is performed for a normal engine operation control, traction control and so forth.

In the shown embodiment, the accelerator pedal (not shown) is used for generating a signal relating to an accelerator position and is not adapted to directly operate the throttle valve 6 to open and close through an accelerator wire such as that in the conventional mechanical type accelerator pedal. Therefore, the accelerator position sensor can be set separately from the throttle mechanism.

As a return spring 31, a volute spring is employed for contributing for rationalization (down-sizing) of a space of the spring casing portion 30. The spring casing portion 30 is integrally formed of a synthetic resin together with the gear casing. The gear cover 26 is also used as the spring casing portion 30. In the gear cover 26, a rib 100 is provided for preventing the gear cover 26 from bowing during molding.

Among outer wall of the throttle body 1, from one surface of the outer wall on the side remote from the gear receptacle portion 25, a cylindrical wall 1C is extended integrally with the throttle body 1. Within the cylindrical wall 1C, a space 33 for aggregatingly housing a sleeve form boss portion 1E receiving the bearing 4, the throttle position sensor 32, a lead wire of the throttle actuating motor 7, a connector 41 for the throttle actuating motor 7 and so forth (hereinafter referred to as sensor receptacle portion) is defined. The sensor receptacle portion 33 is covered with a sensor cover 35 which will be discussed later.

The throttle position sensor 32 may be a potentiometer type sensor, for example. As shown in FIG. 2, a movable element 32*a* is mounted on one end 3B of the throttle shaft 3 for rotation therewith. Associating with rotation of the throttle shaft 3, a conductive brush 32*b* provided on the outer periphery of the movable element 32*a* slidingly contact on a resistor 32*c* provided on a stator (sensor casing 34) for taking out an electrical signal depending upon the throttle valve angular position via the conductive brush 32*b*. The stator is constructed by the sensor casing 34 of the throttle position sensor. On the inner periphery of the sensor casing 34, a film form resistor 32*c* is formed.

The sensor casing 34 is constructed with a casing body 34*a* and a bottom plate 34*b*. As shown in FIGS. 2, 5 and 12, on the surface side of the casing body 34*a*, a projection 34*a*' for installation of connector terminals is formed. Connector terminals (power source terminal and sensor output terminal) 37 for electrical connection with an external electric wiring of the throttle position sensor and connector terminals 38 (power source terminal) for electrical connection with an external electric wiring of the throttle actuating motor 7 are aggregatingly mounted on the projection 34*a*'.

These connector terminals 37 and 38 establishes electrical connection with electric wiring by engaging a connector of the not shown external electric wiring from the outside of the throttle body, into a connector casing 35A (the connector casing 35A is provided in the sensor cover 35 covering the sensor casing installing portion) which will be discussed later.

As set forth above, the connector terminals 38 for establishing connection with the electric wiring of the throttle actuating motor in addition to the connector terminals 37 of the throttle position sensor 32 are provided in the sensor casing 34. Also, a space 33 for a motor wiring 40 and a terminal 70 directly mounted on the throttle actuating motor 7 is defined on the side of the throttle position sensor in the throttle body 1 between the sensor casing 34 and the motor casing portion 8. The space 33 for accommodating the motor wiring, is formed in the vicinity of the sleeve form boss portion (bearing box) 1 of the bearing 4 for the throttle shaft 3.

Assuming that the end portion on the side of the output shaft (shaft) 17 of the throttle actuating motor 7 is a front side and the opposite end portion is a rear side, the terminal (power source terminal) 70 directly mounted on the motor is provided on the rear side end cover 7B in opposition to the installation portion side of the throttle position sensor 32. On the terminal 70 directly mounted on the throttle actuating motor 7, a connector 41 provided on one end of the lead wire 40 is mated for electrical connection. The other end of the lead wire 40 is connected to the terminals 38 provided on the side of the sensor casing 34 (see FIGS. 5 and 12).

The sensor cover 35 is mounted on the external wall of the throttle body 1 by an appropriate fastening means 42, such as rivet, screw and so forth with covering throttle position sensor 32. The sensor cover 35 is molded of the synthetic resin, for example. In a part of the sensor cover, a connector casing (female type) 35A for aggregatingly receiving the connector terminal group 37 and 38 provided in the sensor casing 34, is arranged projecting from the surface of the sensor cover 35. Into the connector casing 35A, a male connector (not shown) of the electric wiring outside of the throttle body as a composite wiring of the power source wiring of the throttle actuating motor 7, the power source wiring of the throttle position sensor 32 and a sensor output wiring, is mated for establishing electrical connection between the external electric wiring and the connector terminals 37 and 38.

Mounting positions of the throttle position sensor 32 and the air flow sensor 9 on the outer wall of the throttle body 1 are arranged to orient the mounting surfaces with an angular offset of 90° with respect to each other, as shown in FIGS. 3, 5 and 6. In consideration of convenience of mating direction of the connector of the external electric wiring (not shown), a directionality of the connector casing 35A provided in the sensor cover 35 of the throttle position sensor 32 and the connector casing 14A providing in the sensor casing 14 of the air flow sensor 9 are matched with each other.

Namely, in the shown embodiment, the throttle body 1 is formed in a form orienting an internal air intake bore 2 upon installation within the engine room. On the upper surface of the throttle body 1, which is located at the upper side upon installation, directionality of the connector terminals 38, 80, 81 and 82 with respect to respective external electric wiring of the throttle actuating motor 7 and the air flow sensor 8 are matched toward one side of the throttle body 1. On the side surface of the external wall of the throttle body toward which the connector terminals are oriented, the throttle position sensor 32 is arranged. The connector terminals for the external electric wiring of the throttle position sensor 32 are also oriented with matching the directionality with the connector terminals 38 and 70 for the throttle actuating motor 7 and the connector terminals 80 to 82 of the air flow sensor 9.

On the other hand, as set forth above, the connector terminals 37 of the throttle position sensor 32 and the connector terminals 38 of the throttle actuating motor 7 are aggregatingly provided in the sensor casing 34 of the throttle position sensor 32.

Next, discussion will be given for the initial opening setting mechanism and a mechanism for restricting fully closed position and fully open position of the throttle valve, provided in the throttle body 1.

As set forth above, the initial opening setting mechanism is a mechanism for setting the initial opening of the throttle valve at an angular position greater than a minimum point of the motor control while the engine key is held OFF, in other words, while the electric power is not supplied to the throttle actuating motor. Here, the minimum point of the throttle valve in the motor control generally corresponds to an idle opening in the steady state of the engine after warm-up. However, in consideration of restriction of the air flow rate during deceleration and according to shaking down of engine depending upon secular change, the idling opening tends to gradually reduce the idle opening. Thus, the initial minimum point of the motor control can be set to be slightly smaller than the initial idle opening.

FIGS. 10 and 17 show initial opening setting mechanism.

As shown in FIGS. 10 and 17, a lever 21' for setting the initial opening (hereinafter occasionally referred to as default lever) is integrally formed with the throttle gear 21, and rotates together with the throttle shaft 3.

On the other hand, in the cylindrical wall 1B of the gear receptacle portion 25, a lever receptacle 51 is provided to contact with the default lever 21' when the throttle shaft 3 performs return operation in closing direction and the throttle valve 6 approaches a predetermined position.

The lever receptacle 51 is in a cylindrical shape with a pin, for example, and is received with a guide (cylindrical portion) 54 provided in the cylindrical wall 1B as being supported by a spring 52 for setting the initial opening (hereinafter referred to as default spring), for sliding (reciprocal) movement in the axial direction of the guide 54. A tip end pin portion of the lever receptacle 51 projects from one end of the sleeve 54 to extend into the space of the gear receptacle portion 25.

One end of the default spring 52 is seated on an adjuster screw 53 engaged in the cylindrical portion 54. The other end of the default spring 52 is introduced within the lever receptacle and seated on the inner end surface of the lever receptacle 51. Thus, the default spring 52 applies a biasing force in a direction opposite to the return spring (opening direction of the throttle valve 6). A position where a balance is established between the spring forces of the default spring 52 and the return spring 31, is the initial opening position (see FIG. 10).

As set forth above, the default spring 52 is disposed between the lever receptacle 51 and the adjuster screw 53. Accordingly, the initial opening position can be adjusted by adjusting the spring force of the default spring 52 through the adjuster screw 53. When the throttle valve is in a range between a fully closed stopper position to the initial opening position, the spring force of the default spring in the state where the electric power is not supplied is greater than the spring force of the return spring 31. Accordingly, in order to control the throttle valve 6 in a range between the initial opening position to the fully closed stopper position, a driving force of the throttle actuating motor 7 is required. In a range from the initial opening position to a fully open position of the throttle valve 6, the spring force of the return spring 31 acts effectively. A member 55 inserted into the sleeve 54 is a seal plug.

Here, discussion will be given for a mechanism to define the minimum opening and the maximum opening of the throttle valve.

In the shown embodiment, the minimum opening and the maximum opening of the throttle valve 6 can be defined by two mutually distinct ways. One way is to mechanically define the positions corresponding to the minimum opening and the maximum opening by a member rotating integrally with the throttle shaft 3 (here, a throttle gear 21 having the default lever 21') by abutting with stoppers. The other way is to electrically control (motor control) the throttle valve within the range of the minimum opening and the maximum opening in the mechanical control set forth above, for defining the minimum and maximum opening positions. The later electrical control is used for actual operation in the shown embodiment. Hereinafter, in order to distinguish from the minimum mechanical and maximum opening, the minimum opening and the maximum opening in the electrical motor control will be referred to as motor controlled minimum opening and motor controlled maximum opening. A throttle valve opening control in a range between the motor controlled minimum opening and the motor controlled maximum opening is performed by a driving force of the throttle actuating motor 7 in response to an opening control signal from the TCM.

Figure 13:
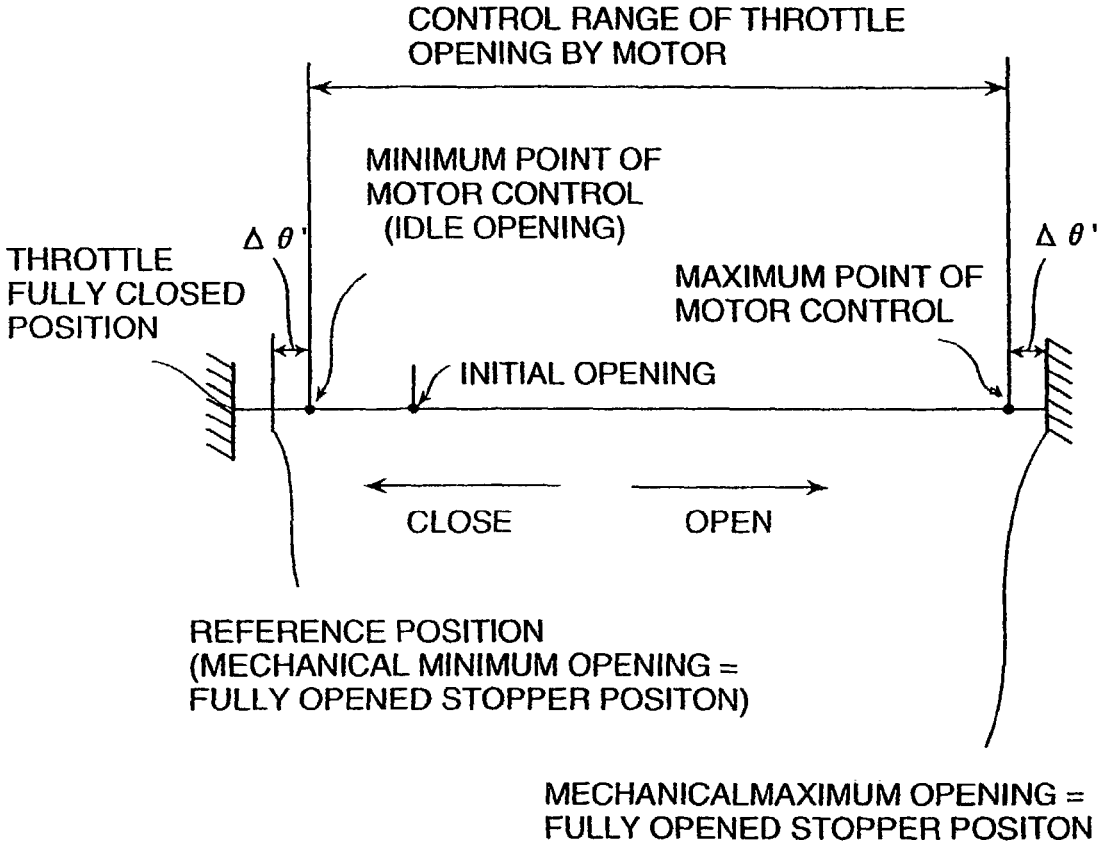
FIG. 13 is an explanatory illustration showing a control range of a throttle opening.

As shown in FIG. 13, the foregoing minimum mechanical opening and the maximum opening is not used during driving of the vehicle in the shown embodiment, but throttle valve opening control is performed within the range of the motor controlled minimum opening and the motor controlled maximum opening. The motor controlled minimum opening of the throttle valve is greater than the minimum mechanical opening in the extent of $\Delta\theta$ (e.g. $\Delta\theta$=0.5 to 1.0°). On the other hand, the motor controlled maximum opening of the throttle valve control is smaller than the maximum mechanical opening in the extent of $\Delta\theta'$ ($\Delta\theta'$ later). The fully closed position shown in FIG. 13 represents a zero point in the case where the stopper is not present.

In the shown embodiment, the minimum mechanical opening of the throttle valve is the angular position established by fully driving the throttle shaft 3 by the driving force of the throttle actuating motor 7 against the spring force of the default spring 52, contacting the lever 21' integrated with the throttle gear 21 onto the lever receptacle 51, and abutting the lever receptacle 51 as depressed by the lever 21' onto the adjuster screw 53.

On the other hand, the maximum mechanical opening is the opening of the throttle valve when one edge 21A of the sectorial throttle gear 21 is moved to the stopper 21B provided on the throttle body 1 (see FIG. 7) by driving the throttle shaft 3 in the opening direction with the driving force of the throttle actuating motor 7.

Namely, the valve opening restricting mechanism of the shown embodiment is constructed as follow. As shown in FIG. 7, a movable stopper element A (lever 21') is formed for restricting the opening of the throttle valve in the closing direction on the sectorial throttle gear 21, and the one edge 21A of the throttle gear 21 is taken as a movable stopper element B for restricting the opening of the throttle valve in the opening direction.

On the other hand, on the throttle body 1, a stationary stopper element B' (a part 21B of the cylindrical portion 54) is provided for defining the maximum mechanical opening position of the throttle valve by receiving the movable stopper element B (one edge 21A of the gear) when the throttle valve 6 is fully opened.

Also, on the throttle body, a member A' (lever receptacle 51) receiving the movable stopper element A (lever 21') when the throttle valve 6 reaches a position close to the fully closed position, and the spring 52 for setting the initial opening by applying the spring force on the movable stopper element A (lever 21') via the receptacle member A1 (lever receptacle 51), in the opening direction against the spring force of the return spring 31 in order to maintain the initial opening of the throttle valve 6 while the electric power is not supplied to the throttle actuating motor 7, greater than the motor controlled minimum opening position, are provided.

The receptacle member A' (lever receptacle 51) and the default spring 52 are installed in the throttle body 1 together with the adjuster screw 53. The default spring 52 is disposed between the receptacle member A' and the adjuster screw 53 for permitting adjustment of the spring force thereof by means of the adjuster screw.

When the throttle actuating motor 7 is driven to fully rotate the throttle valve 6in the closing direction against the spring force of the default spring 52, the receptacle member A' (lever receptacle 51) is depressed to abut onto the adjuster screw 53. By the adjuster screw 53, the stationary stopper element A" defining the minimum mechanical opening position of the throttle valve 6 can be constructed.

Here, it is defined that the throttle valve opening is 0° when the throttle valve 6 is in a position perpendicular to the axis of the air intake passage 2 of the throttle body, and the throttle valve opening is 90° when the throttle valve 6 is in a position parallel to the axis of the air intake passage 2 of the throttle valve 6. For example, in the shown embodiment, the minimum mechanical opening shown in FIG. 13 is in a range of about 6 to 7°, the motor controlled minimum opening position is greater than the minimum mechanical opening in the extent of 0.5 to 1°, the initial opening is several tens, the motor controlled maximum opening is 90°, and the maximum mechanical opening is greater than or equal to 90° (e.g. equal to or more less than 95°).

As shown in FIG. 13, by setting a range of the motor controlled minimum opening and the motor controlled maximum opening within a range of the minimum mechanical opening to the maximum opening, with providing a margin in the extent of $\Delta\theta$ and $\Delta\theta'$, the movable stopper element B may not be in contact with the stationary stopper B1 at the motor controlled maximum opening and the receptacle member A' may not be in contact with the adjuster screw 53 at the motor controlled minimum opening so that a mechanical shock is applied to a gear mechanism G via the throttle gear 21 (mechanism to be received by the stopper). Thus, mechanical fatigue, wearing, damaging can be avoided. Also, galling of the stopper can be prevented.

Furthermore, by setting the maximum mechanical opening to be greater than or equal to 90°, the motor controlled maximum opening of the throttle valve as controlled electrically can be widened up to 90° with maintaining a margin (in contrast to this, the motor controlled maximum opening has been limited to be less than 90°, conventionally). By employing the setting set forth above, the throttle valve 6 at the motor controlled maximum opening becomes parallel to an air flow for minimizing air flow resistance across the throttle valve to limit a pressure loss in the air intake passage as small as possible.

In the shown embodiment, when the engine key is turned-on, the throttle valve 6 is once driven from the initial opening position to the minimum mechanical opening position (position to abut with the adjuster screw) by the throttle actuating motor 7, This is for learning a reference position in a throttle control (namely, the minimum mechanical opening position becomes zero point on the control). Subsequently, on the basis of the coolant temperature of the engine, the throttle position sensor, the traction control signal and so forth, control of opening of the throttle valve can be performed within the range of the motor controlled minimum opening and the motor controlled maximum opening. As set forth above, learning of the minimum mechanical opening position is performed while the engine key is held OFF for assuring safety.

In the shown embodiment, by the throttle apparatus, following advantages can be achieved.

a) The throttle actuating motor 7, the throttle position sensor 32, the air flow sensor 9 are concentrically arranged on the throttle body 1. On the other hand, operation for assembling the air flow sensor body and the throttle body which are otherwise formed separately, in the air intake passage, can be eliminated, so that assembling operation can be completed by single assembling operation of the throttle apparatus. On the other hand, the various external electric wiring such as the sensor output line, the power source wiring, the ground line and so forth can be aggregated on the closer side to the throttle body 1. Thus, rationalization of the wiring connecting operation can be achieved.

b) Since the motor casing portion 8 for the throttle actuating motor 7 and the mounting portion 10 of the air flow sensor 9 are formed on the upper surface of the throttle body 1, which upper surface is to be located on the upper side upon installation in the engine room, the air flow sensor 9 as an accessory of the throttle apparatus, can be taken out from the throttle body 1 independently and easily, after installation of the throttle body 1 within the engine room for enhancing convenience in inspection, maintenance and exchanging. On the other hand, since the motor casing portion 8 extends over the upper surface of the throttle body 1, a step is formed between the motor casing portion 8 and the upper surface of the remaining throttle body 1. A space defined by the step can be effectively utilized as an installation space of the air flow sensor 9. Therefore, wasting of space around the throttle body can be eliminated to increase density of concentration in mounting of the parts.

c) Various external electric wiring (sensor output line, the sensor power line, the motor line and so forth) can be lead from the engine control unit to the throttle body. In the shown embodiment, since the connector terminals of electrical connection for the external electrical wiring of the throttle actuating motor 7, the throttle position sensor 32, the air flow sensor are matched directionality so that various electric wiring are not required to be lead from different directions to make operation for establishing electrical connection quite simple.

d) The connector casing 35A of the sensor casing of the throttle position sensor 32 can additionally serve as a connector portion for the external electric wiring of the throttle actuator, such as the throttle actuating motor, in addition to the connector portion for electrical connection for the external electric wiring for the throttle position sensor per se. Also, by matching directionality of the connector terminals 37 and 38 for electrical connection with those electric wiring, connecting operation for the foregoing various electric wiring can be further simplified.

e) Furthermore, since the connector terminals 37 of the throttle position sensor 32 and the connector terminals 38 of the throttle actuating motor 7 are aggregatingly provided in the female type connector casing 35A provided in the sensor cover 35 of the synthetic resin which covers the sensor casing 34, the connector portion (connector casing) 35A can be concentrated. Correspondingly, the external electric wiring of the throttle position sensor 32 and the external electric wiring of the throttle actuating motor 7 can be aggregated to be concentrically terminated to the connector portion (male connector casing). Thus, connecting operation of the electric wiring can be performed by simply mating the male connector and the female connector.

f) It is expected that the different shapes of the connector casings of the electrical wiring are used in respective of makers. Even in such case, the sensor casing 34 of the throttle position sensor 32 may be used as is and it is only required to exchange the resin sensor cover 35 to one having the connector casing 35A adapted to the shape of the male connector on the electric wiring. Therefore, the throttle position sensor 32 may be common to respective makers to improve compatibility of the parts.

g) The motor casing 8 is provided a tapered motor insertion opening 8A increasing the diameter from the bottom side to the opening side so that the diameter of the opening side of the motor insertion opening 8A becomes greater than the external diameter of the throttle actuating motor 7. Therefore, the throttle actuating motor 7 can be smoothly increased into the motor casing portion 8 in the throttle body 1. Furthermore, even when a gap is formed between the inner diameter on the opening side of the motor insertion opening 8A and the outer diameter of the throttle actuating motor 7, rattling of the throttle actuating motor in the radial direction can be successfully prevented by contacting the outer periphery of the flange of the end cover 7A of the throttle actuating motor projected from the motor casing portion 8 with the inner periphery of the stoppers 89 and 1B. It should be noted that the diameter of the motor casing 8 on the bottom side is substantially the same as the outer diameter of the rear side of the throttle actuating motor 7 so as not to cause rattling.

Particularly, since the stopper 89 is integrated with the mounting boss 88 of the gear shaft 27 and the cylindrical wall 1B of the gear receptacle portion 25 of the throttle body is utilized as the stopper 1B, the parts can be optimized.

h) Since the volute spring is employed as the return spring, down-sizing of the spring can be achieved. Furthermore, since the return spring 31 is housed within the spring casing 30 formed in the gear cover 26, when the gear cover 26 is set in the throttle body 1, the return spring can be set simultaneously. Thus, assembling of the parts can be simplified to make assembling operation efficient. Also, since the end cover 7A is provided with the flange, the throttle actuating motor 7 can be directly mounted on the throttle body 1 utilizing the flange.

i) Since the lever 21' of the initial opening setting mechanism is integrated with the throttle gear 21, the throttle body 1 is only required to house the adjuster screw 53, the spring 52 for setting the initial opening, the lever receptacle 51 within the cylindrical portion 54 provided at one portion. Furthermore, since the adjuster screw 53 for adjusting the spring force of the spring for setting the initial opening can also be used as the stopper determining the minimum mechanical opening position of the throttle valve. Thus number of parts can be reduced.

On the other hand, the movable stopper element determining the maximum mechanical opening position is formed by one edge 21A of the throttle gear 21, and the wall portion of the cylindrical portion 54 of the initial opening setting mechanism is utilized as the stationary stopper element 21B. Therefore, parts for the stopper elements can be reduced.

j) Since the throttle valve 6 is placed in substantially parallel to the intake air flow at the motor controlled maximum opening, a resistance in the air intake passage 2 can be reduced to restrict pressure loss.

FIG. 14 is a partial section showing the second embodiment of the throttle apparatus according to the present invention. In FIG. 14, only point different from the first embodiment will be illustrated. It should be noted that like reference numerals to those of the first embodiment identify like elements.

The difference between the shown embodiment and the first embodiment is not use the resin sensor cover 35 covering the mounting portion 33 of the throttle position sensor 32 but the connector casing 35A' is directly formed on the sensor casing 34. On the backside of the sensor casing 34, the connector terminals 75 for connecting to the power input terminal directly mounted on the throttle actuating motor 7 is arranged so that the power input terminal directly mounted on the throttle actuating motor and the connector terminal 75 provided on the backside of the sensor casing 34 are provided terminal construction to establish connection via a sleeve joint 76 when the sensor casing 34 is mounted on the outer wall of the throttle body.

The sleeve joint 76 is formed with a conductive tube having engaging portion sealingly engaged with pins of the terminals 75 and 76 on both ends.

It should be noted that the sleeve joint 76 is mounted on any one of the terminals 75 and 70 to see that the sleeve joint is a part of the terminal on the mounting side, the power input terminal 70 directly mounted on the throttle actuating motor 7 and the connector terminals for electrical connection of the external electric wiring of the throttle actuating motor are concentrically provided at one portion. Also, these terminals are housed within the connector casing 35A.

With such construction, the external electric wiring for connecting the throttle position sensor 32 and the throttle actuating motor 7 can be connected by one connector portion 35A on the surface side of the sensor casing of the throttle position sensor 32, on the throttle body 1, within the engine room. Also, even when the throttle position sensor 32 is mounted on the throttle body 1 before installation within the engine room, the connector terminal 75 corresponding to the throttle actuating motor provided on the backside of the sensor casing can be mated with the power input terminal 70 directly mounted on the throttle actuating motor within the sensor mounting space, at one action to successfully simplify connection of electrical wiring on the inside or outside of the throttle body.

As set forth above, by the present invention, various sensor parts and actuators can be concentrically mounted on the throttle valve to simplify installing operation into the engine room, wiring operation with reducing the installation space to improve efficiency in the engine control and to enhance productivity of the mechanical parts.

Also, it becomes possible to provide the electrically controlled throttle apparatus with assuring stable operation of the throttle mechanism under the motor control and enhancing accuracy in the motor control.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A throttle device for an internal combustion engine, in which a throttle valve is driven by a motor, comprising:

a throttle body having a recess for said motor;

a cover with flanges for covering an opening of said recess, a shaft of said motor extending therethrough;

said flanges being provided with holes and being secured on said throttle body by bolts;

at least one projection formed on said throttle body and having a face opposing along a part of an outer peripheral edge of said cover.

2. A throttle device for an internal combustion engine, in which a throttle valve is driven by a motor, comprising:

a throttle body having a recess for said motor;

a cover with flanges for covering an opening of said recess, a shaft of said motor extending therethrough;

said flanges being secured on said throttle body;

a curved surface portion being in a frame of said throttle body and a face opposing being along a part of an outer peripheral edge of said cover.

3. A throttle device for an internal combustion engine, in which a throttle valve is driven by a motor, comprising:

a throttle body having a recess for said motor;

a cover with flanges for covering an opening of said recess, and rotatably holding a shaft of said motor;

said flanges being provided with holes and being secured on said throttle body by bolts;

wherein said flanges are provided with at least one curved peripheral portion of said flanges, said curved peripheral portion being configured to be mountable at a curved surface portion in a frame of said throttle body.

4. A throttle device for an internal combustion engine, in which a throttle valve is driven by a motor, comprising:

a throttle body having a recess for said motor;

a cover with flanges for covering an opening of said recess, and rotatably holding a shaft of said motor;

said flanges being secured on said throttle body;

wherein said flanges are provided with at least one curbed peripheral portion of said flanges, said curved peripheral portion being configured to be mountable at a curved surface portion in a frame of said throttle body.

5. A method for assembling a motor driven type throttle valve device to be used for an internal combustion engine, comprising steps of:

forming a recess in a throttle body mounted therein a throttle valve;

providing a wall member having a curved surface around an opening of said recess;

inserting a bracket rotatably holding a rotary shaft of said motor provided a gear at a tip end portion within said wall member to fit on a peripheral surface of said opening; and a flange portion of said bracket and said throttle body being secured by a bolt after aligning a hole provided in said flange portion and a hole provided in said throttle body.

* * * * *